US008794736B2

(12) United States Patent
Watanabe et al.

(10) Patent No.: US 8,794,736 B2
(45) Date of Patent: Aug. 5, 2014

(54) LIQUID EJECTING HEAD AND LIQUID EJECTING APPARATUS

(75) Inventors: Eiichiro Watanabe, Matsumoto (JP); Taiki Hanagami, Matsumoto (JP)

(73) Assignee: Seiko Epson Corporation (JP)

( * ) Notice: Subject to any disclaimer, the term of this patent is extended or adjusted under 35 U.S.C. 154(b) by 179 days.

(21) Appl. No.: 13/566,086

(22) Filed: Aug. 3, 2012

(65) Prior Publication Data

US 2013/0033539 A1 Feb. 7, 2013

(30) Foreign Application Priority Data

Aug. 4, 2011 (JP) ..... 2011-171372

(51) Int. Cl.
*B41J 2/01* (2006.01)
*B41J 2/175* (2006.01)
*B41J 2/17* (2006.01)

(52) U.S. Cl.
USPC ..... 347/20; 347/85; 347/87; 347/93; 347/94

(58) Field of Classification Search
CPC ..... B41J 2/1404; B41J 2/1631; B41J 2/1603; B41J 2002/14387; B41J 2/1623; B41J 2002/14467; B41J 2/175; B41J 2/17596; B41J 2/17509; B41J 2/17513; B41J 2/17553; B41J 2/1752; B41J 2/17556; B41J 2/17503; B41J 2/17506
USPC ..... 347/65, 85, 87, 93, 94
See application file for complete search history.

(56) References Cited

FOREIGN PATENT DOCUMENTS

JP 2009083231 A * 4/2009
JP 2011-056872 3/2011

* cited by examiner

*Primary Examiner* — Lisa M Solomon
(74) *Attorney, Agent, or Firm* — Harness, Dickey & Pierce, P.L.C.

(57) ABSTRACT

A liquid ejecting head includes: a head main body having a manifold in which ink is retained, a compliance section absorbing a pressure change inside the manifold and a compliance space provided opposite to the compliance section, and discharging liquid from nozzles communicating with the manifold; an air chamber communicating with the compliance space and outside; and a liquid reservoir communicating with a liquid flow path supplying liquid to the manifold and volume of which is larger than the manifold, wherein the air chamber and the ink reservoir are divided by a resin adhesive where water vapor is capable of penetrating.

12 Claims, 9 Drawing Sheets

LIQUID EJECTING HEAD AND LIQUID EJECTING APPARATUS

BACKGROUND

1. Technical Field

The present invention relates to a liquid ejecting head and a liquid ejecting apparatus, and specifically, to an ink jet type recording head and an ink jet type recording apparatus in which ink as liquid is discharged.

2. Related Art

A representative example of a liquid ejecting head discharging liquid is an ink jet type recording head discharging ink. In the related art, as an ink jet type recording head, there is known a the recording head including a head main body which has a manifold in which liquid is retained, takes ink in a pressure generation chamber communicating with the manifold, deforms the pressure generation chamber with a pressure generating unit such as a piezoelectric element and then discharges liquid from nozzles.

In the ink jet type recording head described above, a compliance substrate absorbing a pressure change inside the manifold and a compliance space which is a space of the degree not to inhibit the deformation of the compliance substrate are provided. Thus, a recording head having an atmosphere opening path which communicates the compliance space with the outside has been (for example, see, JP-A-2011-056872). When the compliance space is closed, the compliance substrate is difficult to deform due to an increase of a pressure inside thereof and the deformation of the compliance substrate cannot be inhibited by communicating the compliance space with the outside.

Moisture included in ink evaporates and penetrates the compliance substrate and thereby enters the compliance space. When the compliance space communicates with the outside, the tendency thereof is strengthened. In other words, moisture of ink inside the manifold easily evaporates and as a result, viscosity of ink inside the manifold increases. When the viscosity of the ink increases, there is a concern that printing quality may be decreased such as failure of discharging of ink and occurrence of gradation difference in the density of ink which is printed.

In the ink jet type recording head disclosed in JP-A-2011-056872, a control path having high path resistance is provided at the atmosphere opening path and thereby a passing amount of water vapor is suppressed and it is suppressed that liquid becomes water vapor and spreads from the compliance substrate.

However, when the atmosphere opening path dries, moisture of ink inside the manifold further easily evaporates and there is a concern that increase of the viscosity of ink may not reliably prevented. In addition, even though the control path is provided, the control path having a sufficient path resistance may not be provided according to the configuration of the ink jet type recording head, position, size and configuration of the atmosphere opening path or the like.

In addition, such a problem similarly exists in a liquid ejecting apparatus ejecting liquid other than ink.

SUMMARY

An advantage of some aspects of the invention is that it provides a liquid ejecting head and a liquid ejecting apparatus in which an increase of viscosity of liquid is prevented and quality of discharging is improved.

According to an aspect of the invention, there is provided a liquid ejecting head including: a head main body having a manifold in which liquid is retained, a compliance section absorbing a pressure change inside the manifold and a compliance space provided opposite to the compliance section, and discharging liquid from nozzles communicating with the manifold; an air chamber communicating with the compliance space and outside; and a liquid reservoir communicating with a liquid flow path supplying liquid to the manifold and volume of which is larger than the manifold, wherein the air chamber and the liquid reservoir are divided by a resin material where water vapor is capable of penetrating.

According to the aspect of the invention, evaporation of water vapor included in liquid inside the manifold is suppressed and an increase of the viscosity of liquid inside the manifold is suppressed. As a result, failure of discharging according to the increase of the viscosity of liquid can be suppressed and the liquid ejecting head, where high quality discharging is performed, can be provided.

It is preferable that the liquid ejecting head further include: a first flow path member having a first flow path configuring a portion of the liquid flow path; a second flow path member having a second flow path configuring a portion of the liquid flow path; a third flow path member interposed between the first flow path member and the second flow path member; and a circular seal member interposed between the first flow path member and the second flow path member and arranged in circumference of the third flow path member, wherein the air chamber is configured by the first flow path member, the second flow path member and the seal member, the liquid reservoir is disposed between the third flow path member, the first flow path member or the second flow path member, and communicates with the first flow path and the second flow path, and the air chamber and the liquid reservoir are configured by resin adhesive which is a resin member adhering the third flow path member, the first flow path member or the second flow path member to each other. According to the aspect of the invention, the air chamber and the liquid reservoir are formed in the flow path member, and water vapor from the liquid reservoir further reliably can enter the air chamber.

It is preferable that water vapor penetration rate of the resin member be higher than water vapor penetration rate of the compliance section. According to the aspect of the invention, evaporation of moisture included in liquid inside the manifold can be further reliably suppressed and the increase of the viscosity of liquid inside the manifold can be further suppressed.

It is preferable that an area where the resin member exposes to the air chamber be wider than an area where the compliance section faces the compliance space. According to the aspect of the invention, evaporation of moisture included in liquid inside the manifold can be further reliably suppressed and the increase of the viscosity of liquid inside the manifold can be further suppressed.

It is preferable that a thickness of the resin member from the liquid reservoir to the air chamber be thinner than a thickness of the compliance section. According to the aspect of the invention, evaporation of moisture included in liquid inside the manifold can be further reliably suppressed and the increase of the viscosity of liquid inside the manifold can be further suppressed.

It is preferable that the water vapor penetration rate, the surface area, and the thickness of the resin member or the compliance section be set so that quantity of water vapor penetrating the resin member from the liquid reservoir and entering the air chamber is larger than quantity of water vapor penetrating the compliance section from the manifold and entering the compliance space. According to the aspect of the invention, evaporation of moisture included in liquid inside the manifold can be further reliably suppressed and the increase of the viscosity of liquid inside the manifold can be further suppressed.

According to another aspect of the invention, a liquid ejecting apparatus including the liquid ejecting head described above.

According to the aspect of the liquid ejecting apparatus can be provided in which the increase of viscosity of liquid is prevented and quality of discharging is improved.

BRIEF DESCRIPTION OF THE DRAWINGS

The invention will be described with reference to the accompanying drawings, wherein like numbers reference like elements.

FIG. 9 is a schematic view illustrating a relationship of an ink reservoir, an air chamber and the like.

DESCRIPTION OF EXEMPLARY EMBODIMENTS

The invention is described in detail based on embodiments. Hereinafter, an ink jet type recording head is an example of a liquid ejecting head and is also simply referred to as a recording head. In addition, the ink jet type recording head is an example of a liquid ejecting apparatus.

Figure 1:
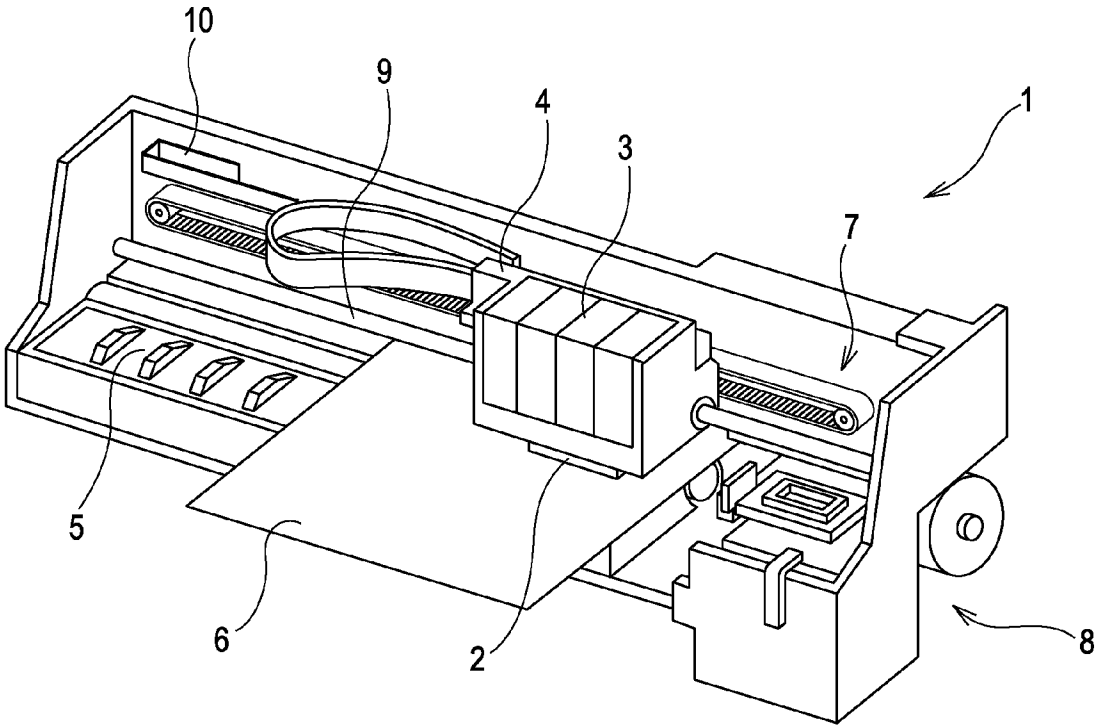
FIG. 1 is a perspective view illustrating a schematic configuration of a recording apparatus according to an embodiment.

FIG. 1 is a perspective view illustrating a schematic configuration of an ink jet type recording apparatus according to the embodiment. An ink jet type recording apparatus 1 includes a recording head 2. The recording head 2 is equipped on a carriage 4 with an ink cartridge 3 and the carriage 4 is provided movable along a carriage shaft 9.

A driving force of a driving motor (not shown) is transmitted to the carriage 4 via a plurality of gears and a timing belt 7 and then the carriage 4 equipped with the recording head 2 is moved along the carriage shaft 9.

A position of the carriage 4 in a direction along the carriage shaft 9 is monitored by a linear encoder 10 and the detection signal is transmitted to a controller (not shown) as position information. Accordingly, the controller can control a discharging operation of ink or the like while confirming the position of the carriage 4 (the recording head 2), based on the position information from the linear encoder 10.

In addition, the ink jet type recording apparatus 1 includes a platen 5. A recording sheet 6, which is a recording medium such as a paper fed by a paper feeding mechanism 8, is wound on the platen 5 and transported.

Figure 2:
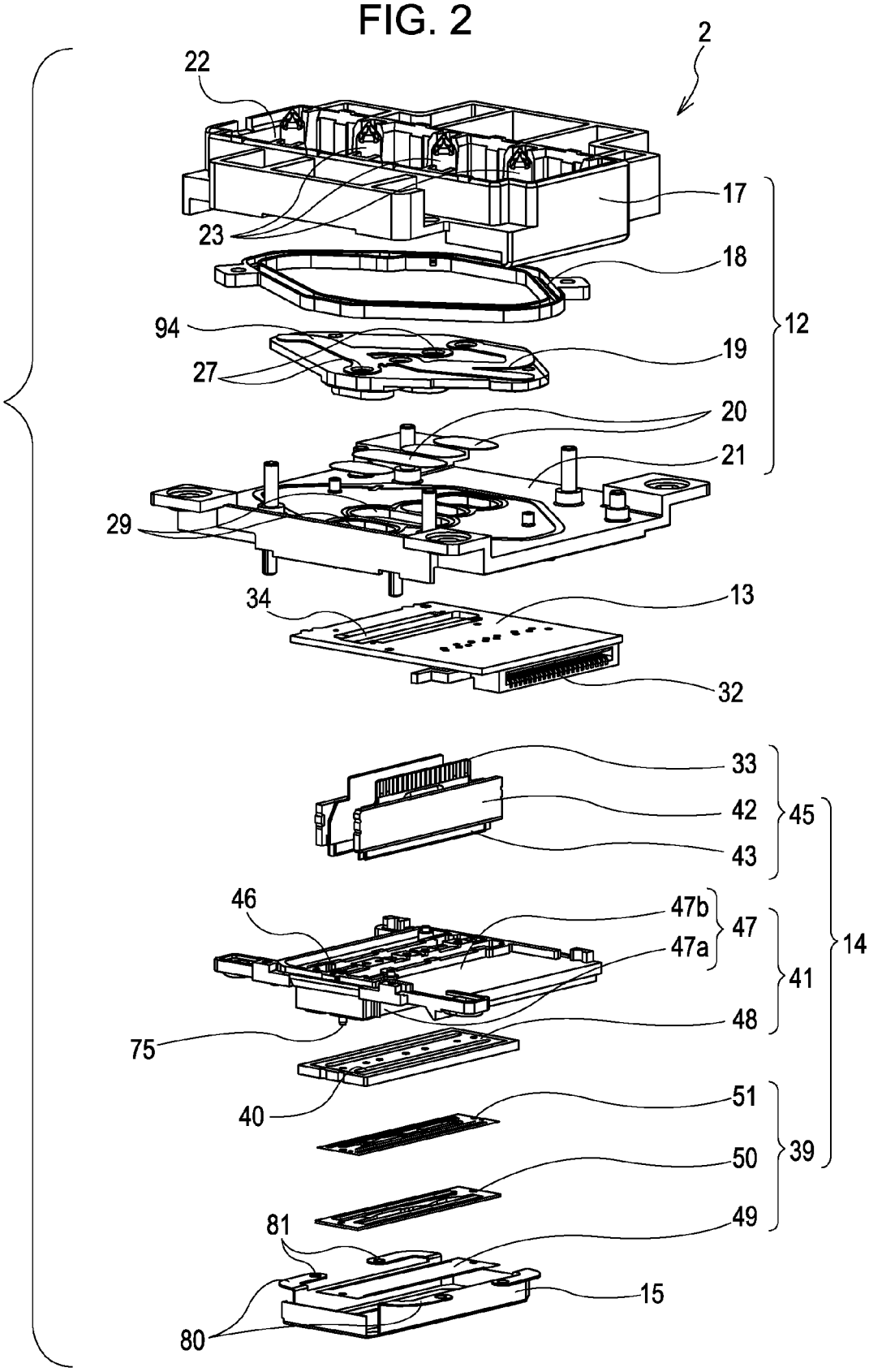
FIG. 2 is an exploded perspective view of a recording head according to an embodiment.
Figure 3A:
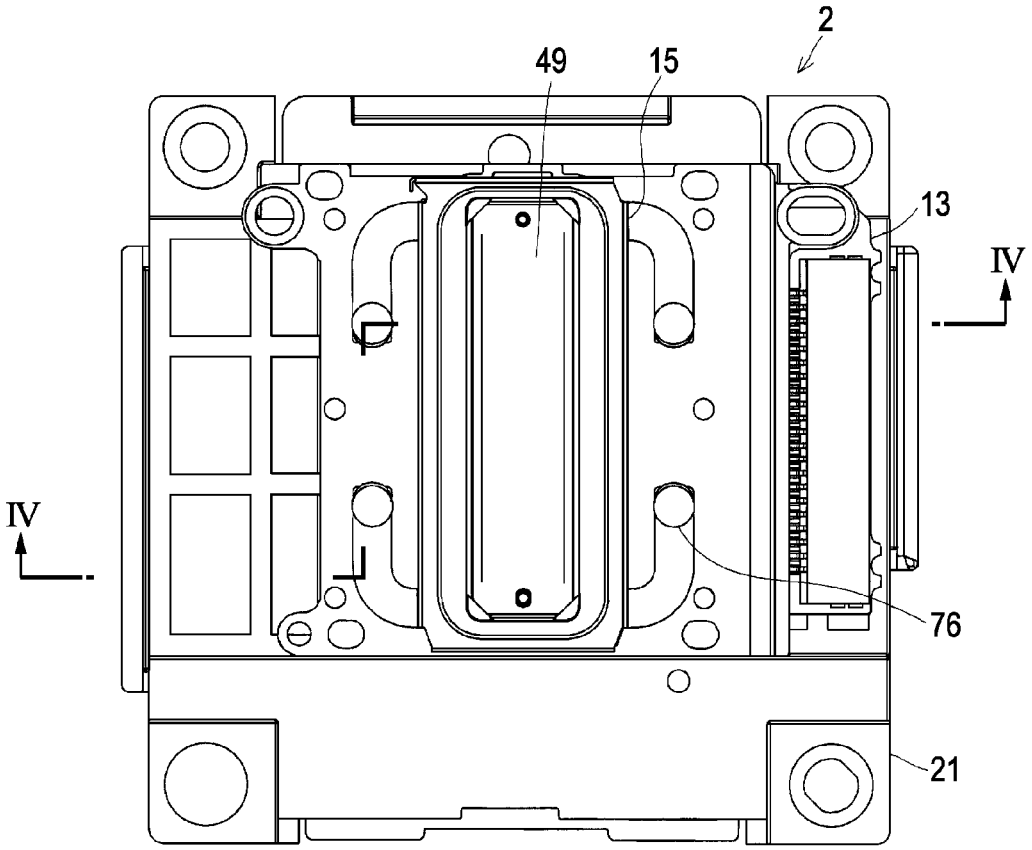
FIG. 3A is a bottom view of a recording head according to an embodiment.
Figure 3B:
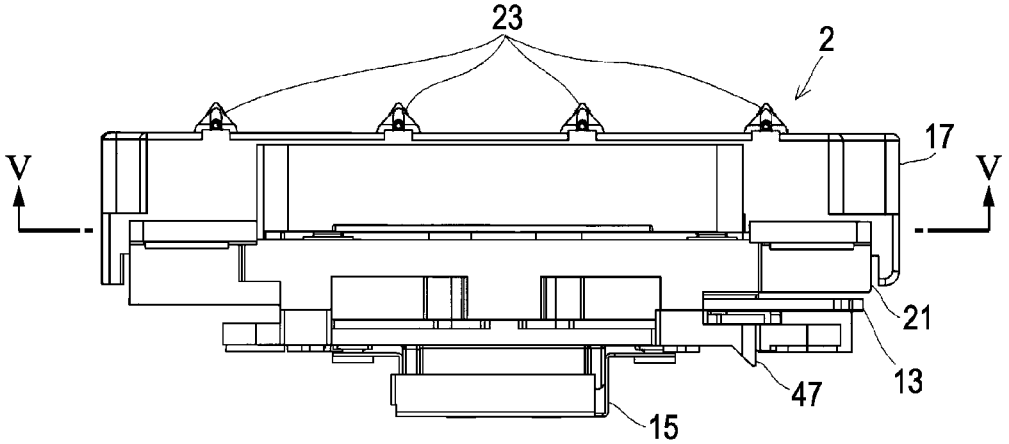
FIG. 3B is a side view of a recording head according to an embodiment.
Figure 4:
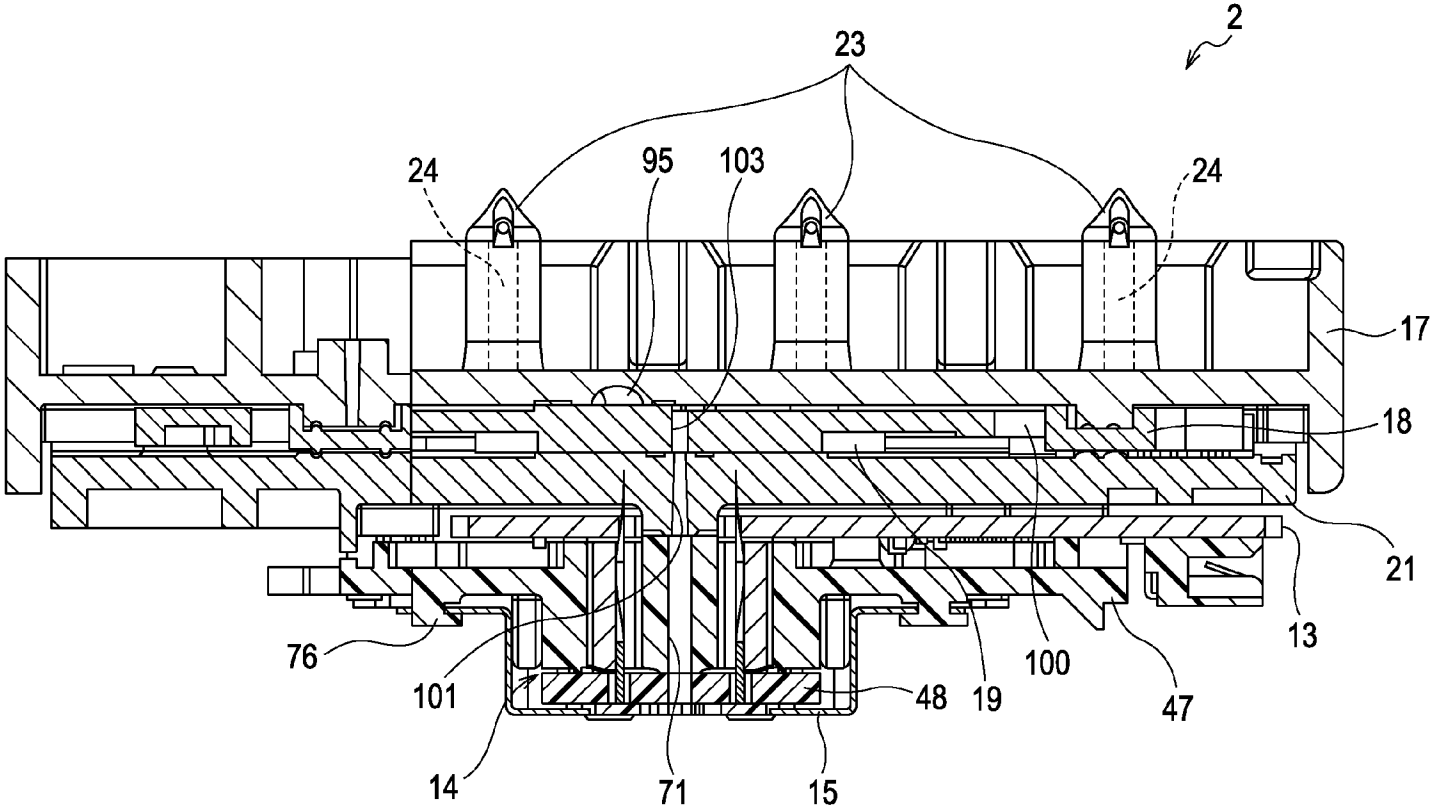
FIG. 4 is a cross-sectional view of a recording head according to an embodiment.
Figure 5:
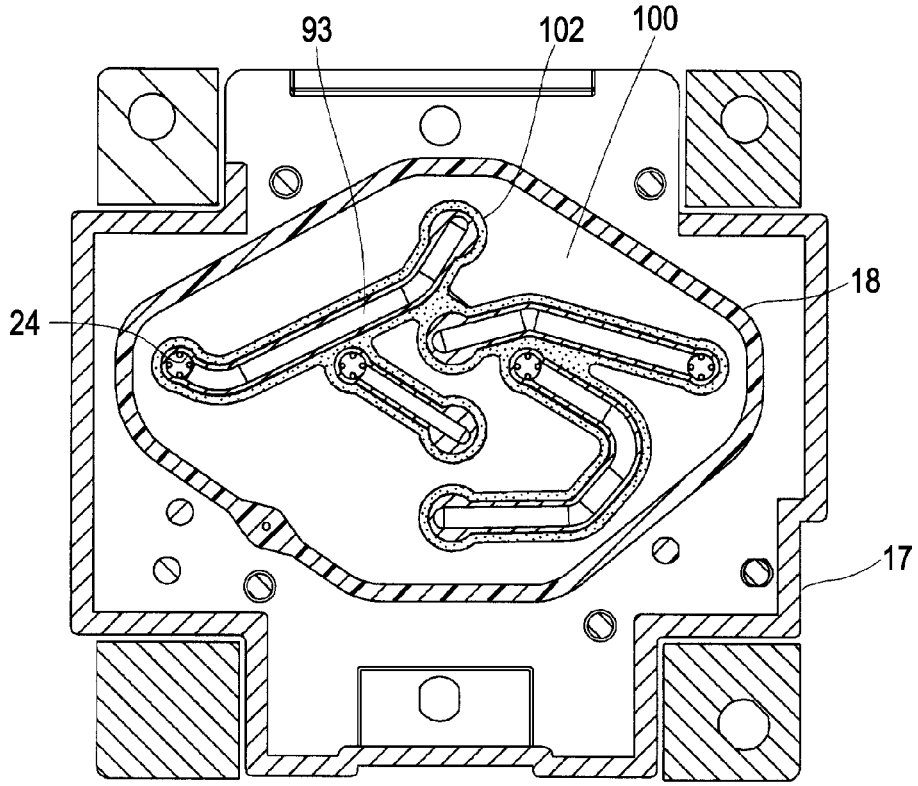
FIG. 5 is a bottom view of a first flow path member according to an embodiment.
Figure 6:
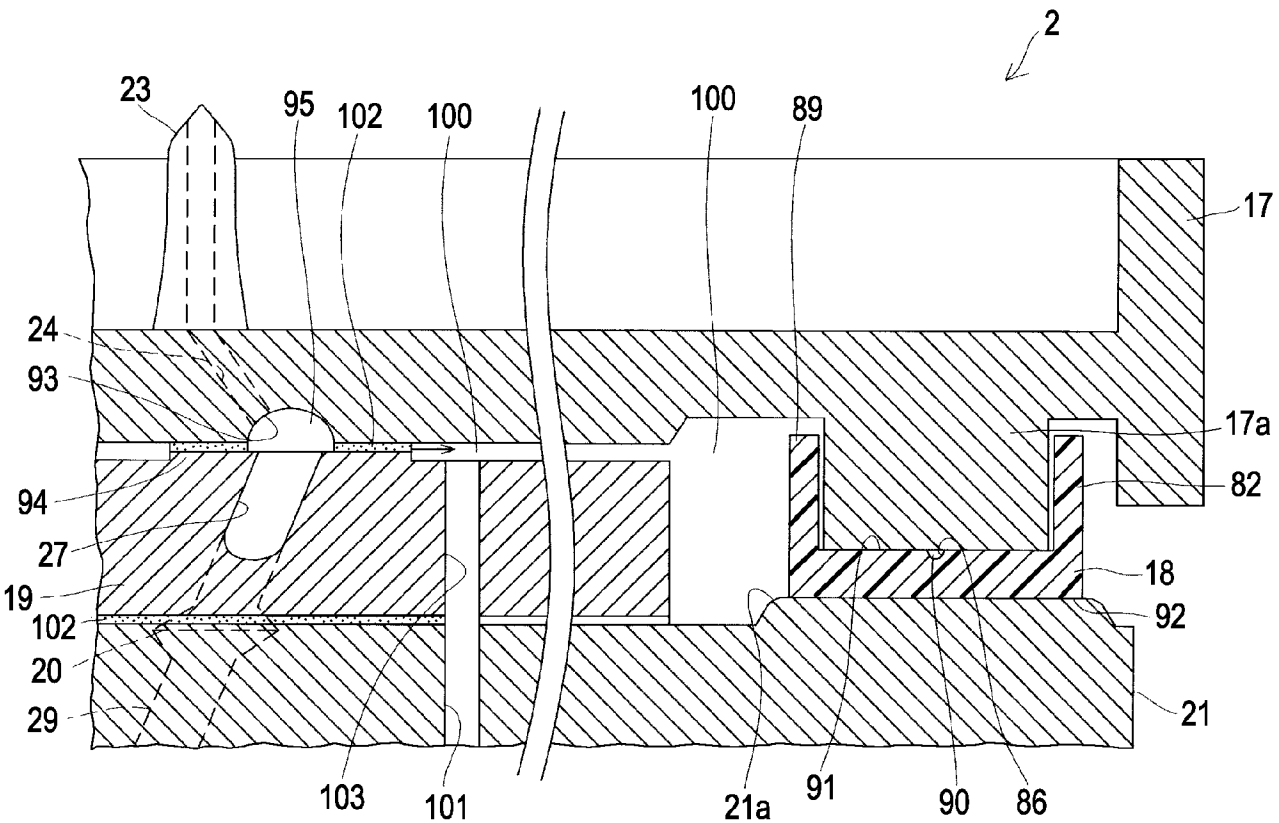
FIG. 6 is a cross-sectional view of a main portion of a recording head according to an embodiment.

FIG. 2 is an exploded perspective view of the recording head 2, FIG. 3A and FIG. 3B are a bottom view and a side view of the recording head 2 respectively, FIG. 4 is a cross-sectional view taken along a line IV-IV of FIG. 3A, FIG. 5 is a cross-sectional view taken along a line V-V of FIG. 3B and FIG. 6 is a schematic cross-sectional view enlarging a main portion of FIG. 4.

As shown in FIGS. 2 to 4, the recording head 2 of the embodiment includes a flow path member 12, a circuit substrate 13, a head main body 14 and a head cover 15.

The flow path member 12 is a member in which a liquid flow path supplying ink from the ink cartridge 3 to the head main body 14 is formed. Specifically, the flow path member 12 is configured by joining a first flow path member 17, a second flow path member 21 and a third flow path member 19.

The first flow path member 17 includes an ink cartridge mounting section 22 where a plurality of ink cartridges 3 is attached removably on an upper surface thereof. A plurality of ink introduction needles 23 is formed on the upper surface of a bottom section of the ink cartridge mounting section 22 corresponding to each of ink cartridges 3 which is mounted. In the embodiment, four ink introduction needles 23 of are arranged corresponding to ink of four colors (for example, cyan, magenta, yellow and black).

A first flow path 24 is formed inside of the ink introduction needle 23. The first flow path 24 and the inside of the ink cartridge 3 are communicated by inserting the ink introduction needle 23 into the ink cartridge 3.

In addition, as shown in FIG. 5, four concave sections 93, which configures a portion of an ink reservoir 95 (described below in detail), are formed on the bottom surface (a surface of the second flow path member 21 side) of the first flow path member 17. The first flow path 24 described above is opened to one end of each of concave sections 93.

As shown in FIGS. 2 and 6, the second flow path member 21 includes a second flow path 29 penetrating the second flow path member 21 in the thickness direction thereof. The second flow path 29 has a tapered shape enlarging the diameter to the first flow path member 17 side a filter 20 is disposed at an opening thereof. In addition, the circuit substrate 13 side of the second flow path 29 protrudes to the circuit substrate 13 side and is inserted into a flow path inserting hole 34 of the circuit substrate 13 described below.

As shown in FIG. 6, the third flow path member 19 is pinched between the first flow path member 17 and the second flow path member 21. The third flow path member 19 is a member defining the first flow path member 17 and the ink reservoir 95 (a liquid reservoir).

The ink reservoir 95 is an example of the liquid reservoir, communicates with the liquid flow paths (the first flow path 24 and the second flow path 29) and is a space which is configured by resin adhesive 102 with an air chamber 100 described below. In addition, the volume of the ink reservoir 95 is greater than that of a manifold 52 of the head main body 14 described below.

Specifically, each of the concave sections 93 (see, FIG. 5) of the first flow path member 17 is sealed in each of convex sections 94 of the third flow path member 19 and thereby the ink reservoir 95 is configured. The convex sections 94 configure a portion of the ink reservoir 95 and four convex sections 94 are provided opposite to each of concave sections 93 of the first flow path member 17 (see, FIG. 2). The third flow path member 19 is adhered to the first flow path member 17 with the resin adhesive 102 coated on a peripheral section of each of the convex sections 94. Accordingly, the opening of each of the concave sections 93 of the first flow path member 17 is sealed in each of convex sections 94 of the third flow path member 19 and four ink reservoirs 95 are formed. In addition, the third flow path member 19 also is adhered to the second flow path member 21 with adhesive.

The ink reservoir 95 according to the embodiment is formed as a flow path having a diameter substantially the same as the diameters of the first flow path 24 and the second flow path 29, and the volume of the flow path is greater than that of the manifold 52.

Of course, the liquid flow path is not limited to the structure such as the ink reservoir 95. For example, the diameter of middle of the liquid flow path is widened and the widened portion may be the ink reservoir. In addition, the middle of the liquid flow path is diverged and then a space, the volume of which is greater than the manifold 52, may be the ink reservoir.

Four communicating paths 27 communicating in the thickness direction thereof are provided at the third flow path member 19. Each of communicating paths 27 opens to one end of each of the convex sections 94 and communicates with the second flow path 29 of the second flow path member 21 via the filter 20. In other words, the ink reservoir 95 communicates with the first flow path 24 and the second flow path 29. In addition, the filter 20 captures air bubbles or foreign materials mixed in ink inside of the first flow path 24.

According to the flow path member 12 having the configuration described above, ink is supplied from the ink cartridge 3 to the liquid flow path configured of the first flow path 24, the ink reservoir 95 and the second flow path 29, and the ink is supplied to the head main body 14.

As shown in FIGS. 2, 4 to 6, a seal member 18 is pinched between the first flow path member 17 and the second flow path member 21. The seal member 18 has an inner diameter greater than an outer diameter of the third flow path member 19 and is an elastic member configured of resin or the like formed in circular shape. In the embodiment, a boss (not shown) is provided on a surface of the first flow path member 17 side of the second flow path member 21, and is heated in a state where the boss penetrates the second flow path member 21 and crimped. Accordingly, a pressure is applied to the seal member 18 from the first flow path member 17 and the second flow path member 21.

The air chamber 100 is configured by the seal member 18, the first flow path member 17 and the second flow path member 21. The air chamber 100 is described below in detail.

As shown in FIGS. 2 and 4, the circuit substrate 13 has electric equipment parts such as an IC and a resistance implemented on the surface thereof. The circuit substrate 13 is arranged between the second flow path member 21 and the head main body 14.

The circuit substrate 13 joins a flexible cable 33 configuring an oscillator unit 45 of the head main body 14. In addition, a connector 32 is provided on the circuit substrate 13 and a signal cable (not shown) is connected thereto. The signal cable is connected to the controller of the ink jet type recording apparatus 1. The circuit substrate 13 is configured such that a driving signal or the like, which is transmitted from the controller via the signal cable, is transmitted and the oscillator unit 45 is driven via the flexible cable 33.

In addition, in the circuit substrate 13, the flow path inserting hole 34, which penetrates in the thickness direction in a region corresponding to the second flow path 29. A lower end of the second flow path 29 is penetrated in the flow path inserting hole 34 and the lower end of the second flow path 29 is connected to an ink supply path 70 (see, FIG. 7) of the head case main body 47 downward from the circuit substrate 13.

Figure 7:
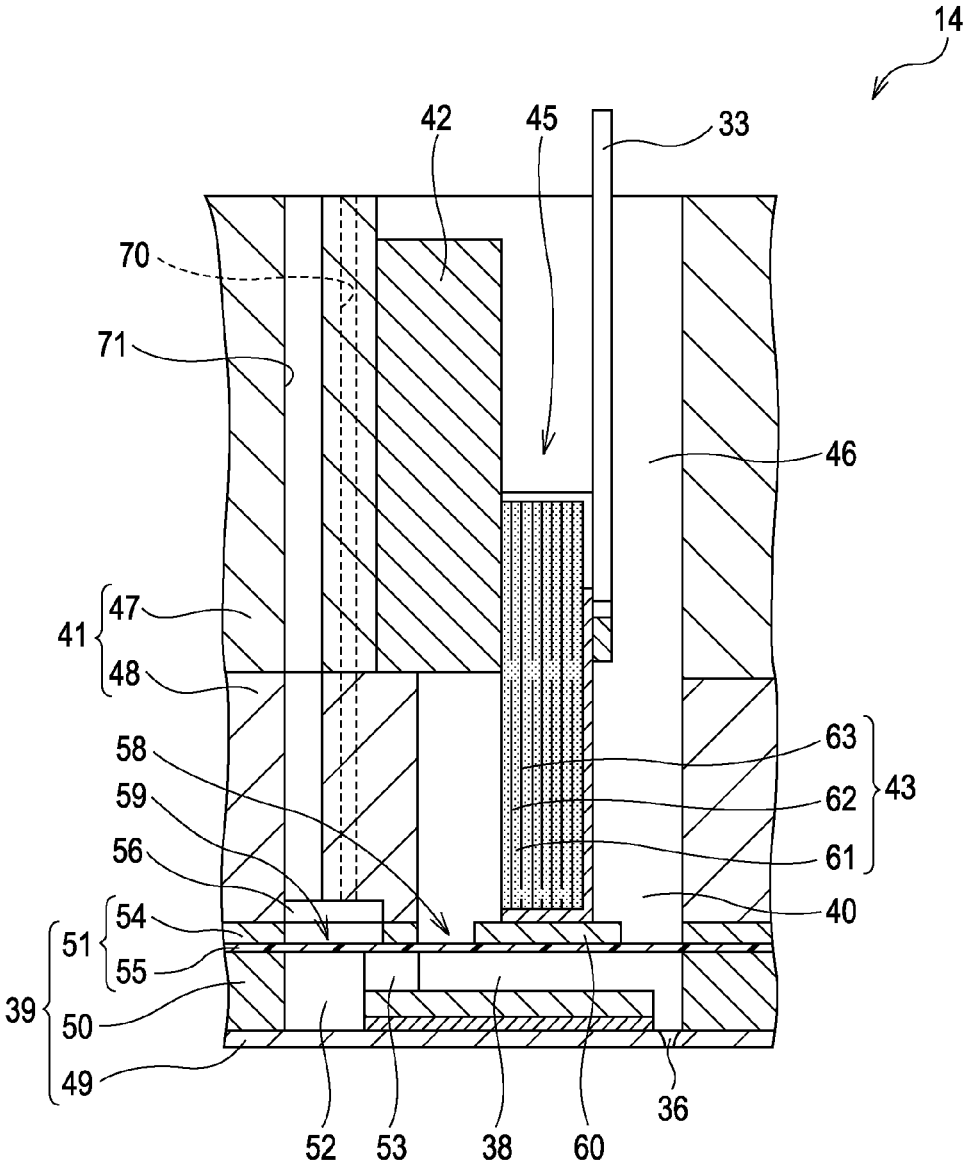
FIG. 7 is a cross-sectional view of a main portion of a head main body according to an embodiment.

FIG. 7 is a cross-sectional view of the head main body according to the embodiment. As shown in the view, the head main body 14 includes a flow path unit 39, a head case 41 and the oscillator unit 45 that is an example of the pressure generating unit.

The flow path unit 39 is configured of a nozzle plate 49, a flow path forming substrate 50 and a vibration plate 51.

In the flow path forming substrate 50, each of pressure generation chambers 38 is divided by a partition wall and provided in a plurality in a line in the width direction thereof. For example, in the embodiment, a column, where the plurality of pressure generation chambers 38 is provided in a line, is provided in two lines on the flow path forming substrate 50.

The manifold 52, which retains ink supplied to each of pressure generation chambers 38, penetrates and is provided in the flow path forming substrate 50 in the thickness direction thereof outside of the column of each of pressure generation chamber 38. Thus, each of the pressure generation chambers 38 and the manifold 52 communicate each other via an ink supply path 53 which is an individual flow path.

As described above, in the embodiment, the flow path forming substrate 50 is configured of a silicon single crystalline substrate and the pressure generation chamber 38 or the like provided on the flow path forming substrate 50 is formed by performing etching of the flow path forming substrate 50.

A nozzle plate 49, where nozzles 36 are formed, is joined to one side of the flow path forming substrate 50. An opposite end portion side of the manifold 52 of the pressure generation chamber 38 to communicate with the nozzle 36.

In addition, the other end side of the flow path forming substrate 50, in other words, the opening surface side of the pressure generation chamber 38 joins the vibration plate 51 and each of pressure generation chambers 38 is sealed by the vibration plate 51. The oscillator unit 45, which is the pressure generating unit generating the pressure to eject ink droplets inside the pressure generation chamber 38, is provided on the vibration plate 51. The oscillator unit 45 is fixed in a state where the front end thereof abuts on the vibration plate 51.

The oscillator unit 45 is configured of a fixing plate 42, a piezoelectric element 43 fixed on the fixing plate 42 and the flexible cable 33 joined to the piezoelectric element 43. In the embodiment, the piezoelectric element 43 is an element where a piezoelectric material 61, electrode forming materials 62 and 63 are alternatively and vertically laminated in sandwich shape. An inactive region that does not contribute to vibration of the piezoelectric element 43 is fixed to the fixing plate 42.

Here, the vibration plate 51, where the front end of the oscillator unit 45 abuts, is formed of a compound plate of an elastic film 55 configured of, for example, an elastic member such as resin film, and a support plate 54 supporting the elastic film 55 and configured of, for example, metal material. The elastic film 55 side is joined to the flow path forming substrate 50.

In addition, an island section 60, where the front end of piezoelectric element 43 abuts, is provided inside of a region of the vibration plate 51 opposite to each of pressure generation chambers 38. In other words, a thin section 58, a thickness of which is thinner than the other regions, is formed at a region of the vibration plate 51 opposite to the peripheral section of each of pressure generation chambers 38 and thereby the island section 60 is provided inside of the thin section 58 respectively.

A compliance section 59, which is substantially configured of only the elastic film 55 where the support plate 54 is removed by etching, is provided at a region of the vibration plate 51 opposite to the manifold 52 similar to the thin section 58. The elastic film 55 of the compliance section 59 is formed of the resin material such as a PPS (polyphenylene sulfide) film, for example, having a thickness of about several μm. Ink does not penetrate the elastic film 55 of the compliance section 59, however, water vapor, where moisture including in ink evaporates, penetrates the elastic film 55.

The head case 41 joins the vibration plate 51. The head case 41 is configured of a head case main body 47 and a reinforcing member 48. The head case main body 47 is produced from resin such as epoxy-based resin, and configured of a hollow box-shaped case section 47*a* (see, FIG. 2) and a plate-shaped section 47*b* (see, FIG. 2) extending from the case section 47*a* to the sideward on the upper end of the case section 47*a*. The reinforcing member 48 is adhered and fixed to the bottom surface of the case section 47*a*. An accommodation space section 46, which is communicated with an inserting opening 40 of the reinforcing member 48, is formed inside of the case section 47*a* and a portion of the oscillator unit 45 is accommodated inside of the accommodation space section 46. In addition, a protrusion section 75, which is positioned with respect to the reinforcing member 48, is protruded to downward at the lower surface of the case section 47*a* (see, FIG. 2).

A first atmosphere communication hole 71, which penetrates in the thickness direction, is formed in the head case main body 47 and the reinforcing member 48.

A compliance space 56, which allows the deformation of the compliance section 59, is formed at a portion of the reinforcing member 48 opposite to the compliance section 59. The compliance space 56 communicates with the air chamber 100 via the first atmosphere communication hole 71. As described below in detail, the compliance space 56 communicates with the air chamber 100 via the first atmosphere communication hole 71, and is opened to the atmosphere via the air chamber 100. Accordingly, the compliance section 59 is favorably deformed with the change of the pressure of the manifold 52.

In addition, the ink supply path 70, which penetrates in the thickness direction, is formed in the head case main body 47 and the reinforcing member 48. One end of the ink supply path 70 communicates with the second flow path 29 as described above, and the other end thereof communicates with the manifold 52.

When the ink droplets are ejected, in the head main body 14 described above, the volume of each of the pressure generation chambers 38 is changed by the deformation of the oscillator unit 45 and the vibration plate 51 and thereby the ink droplets are ejected from predetermined nozzles 36. Specifically, when ink is supplied from the ink cartridge (not shown) to the manifold 52, ink is distributed to each of pressure generation chambers 38 via the liquid flow paths (the first flow path 24, the ink reservoir 95 and the second flow path 29) of the flow path member 12 and the ink supply path 70.

Practically, the piezoelectric element 43 is contracted by applying the voltage to the piezoelectric element 43 of the oscillator unit 45. Accordingly, the vibration plate 51 is deformed with the piezoelectric element 43, the volume of the pressure generation chamber 38 is widened and thereby ink is drawn inside the pressure generation chamber 38. Thus, after ink is filled inside thereof until reaching to the nozzles 36, the voltage, which is applied to the piezoelectric element 43, is released according to the recording signal transmitted from the circuit substrate 13 via the flexible cable 33. Accordingly, the piezoelectric element 43 is extended and returns to an original state and the vibration plate 51 also is deformed and thereby returns to an original state. As a result, the volume of the pressure generation chamber 38 contracts, the pressure inside the pressure generation chamber 38 increases and then ink droplets are ejected from the nozzles 36.

As shown in FIGS. 2 to 4, the head cover 15 is attached to the head main body 14 described above. The head cover 15 connects to the head case main body 47 and is a member made of metal protecting the flow path unit 39 and the head case 41. The head cover 15 is made of a sheet member and surrounds the side surface of the head case 41. The lower end of the head cover 15 bends to the nozzle plate 49 about 90 degree and thereby abutting the surface of the nozzle plate 49. The surface of the head cover 15, which abuts the surface of the nozzle plate 49, is formed in a frame shape to expose the nozzles 36. In addition, flange sections 80 are protruded to sideward at the upper end of the head cover 15 and head cover reference holes 81 are opened to the flange sections 80 (see, FIG. 2). A head cover positioning section 76, which is protruded to the lower surface side of the head case main body 47, is inserted and thereby the head cover 15 is positioned in the head cover reference hole 81.

Figure 8A:
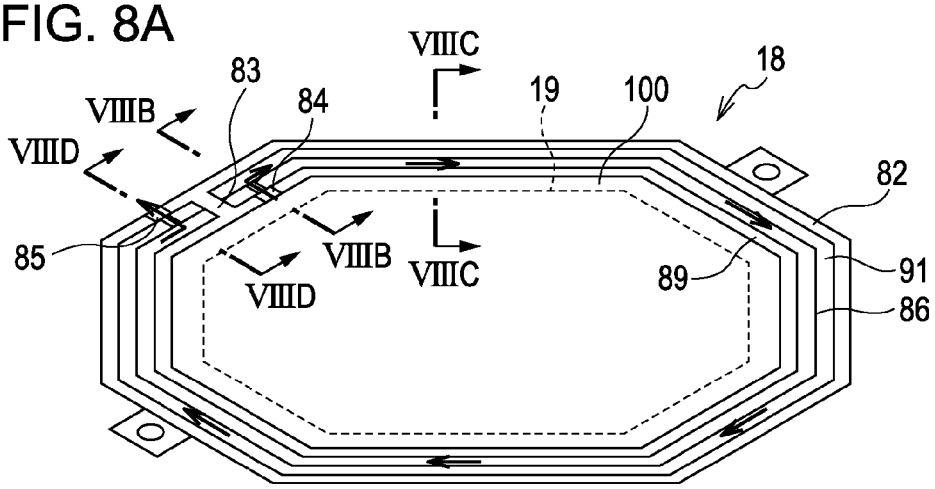
FIG. 8A is a plan view of an atmosphere opening path according to an embodiment.
Figure 8B:
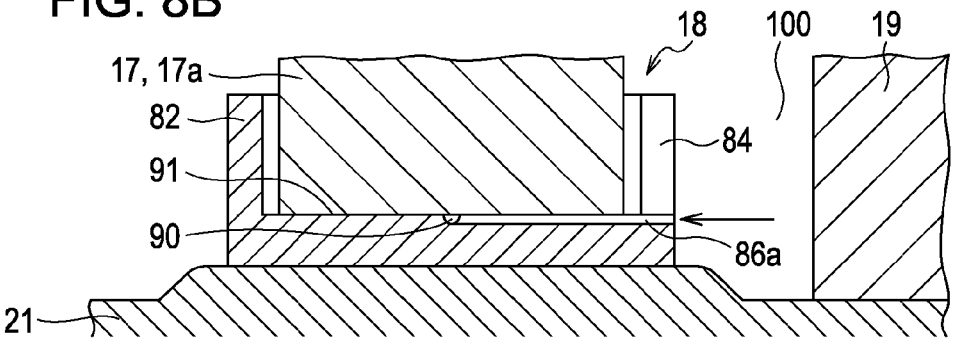
FIGS. 8B to 8D are cross-sectional views of an atmosphere opening path according to an embodiment.
Figure 8C:
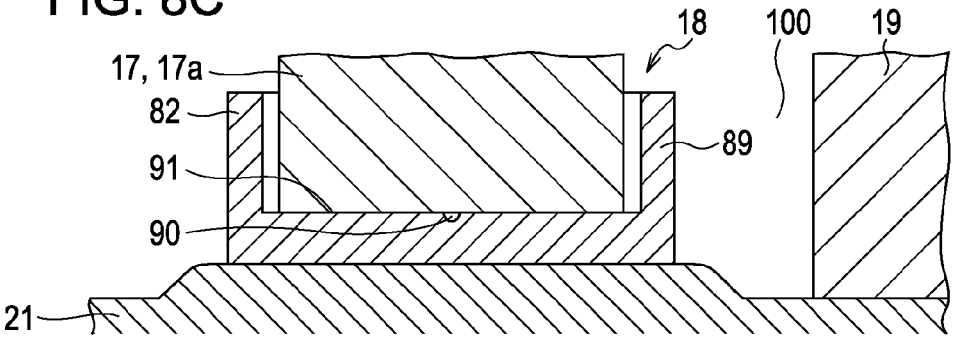
Figure 8D:
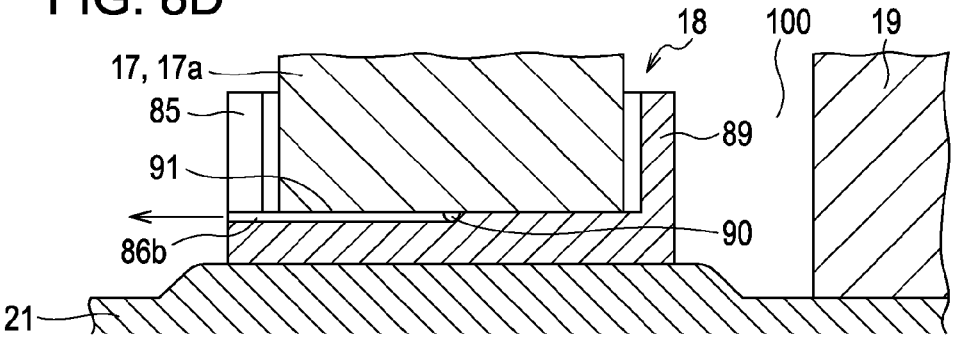

Here, a configuration, where the compliance space 56 is opened to the atmosphere via the air chamber 100, is described in detail using FIG. 6 and FIGS. 8A to 8D. FIG. 8A is a plan view illustrating the atmosphere opening path, FIG. 8B is a cross-sectional view taken along a line VIIIB-VIIIB of FIG. 8A, FIG. 8C is a cross-sectional view taken along a line VIIIC-VIIIC of FIG. 8A and FIG. 8D is a cross-sectional view taken along a line VIIID-VIIID of FIG. 8A.

As shown in FIG. 8A, the seal member 18 is larger than the outer diameter of the third flow path member 19 and is formed in a circular shape. The third flow path member 19 is arranged (see, FIGS. 2 and 4) inside of the seal member 18 and surrounds the entire outer periphery of the third flow path member 19.

As shown in FIG. 8B, a groove section 86 is formed on the upper surface side of the seal member 18, in other words, on a joining surface 91 of a joining side to the first flow path member 17 through the entire circumference of the seal member 18.

As shown in FIGS. 8A and 8C, in the joining surface 91 of the seal member 18, an inner wall section 89 and an outer wall section 82, which pinch the groove section 86 and protrude upward, are formed at both ends respectively. The inner wall section 89 and the outer wall section 82 are provided through the entire circumference of the seal member 18. The joining section 17*a* of the first flow path member 17 is accommodated between the inner wall section 89 and the outer wall section 82, and the joining section 17*a* is abutted to the joining surface 91.

As shown in FIG. 8B, the inner wall section 89 forms an atmosphere inlet section 84 by cutting a portion near a partition section 83. Furthermore, an inlet groove section 86*a*, which is connected to the atmosphere inlet section 84 and the groove section 86, is formed on the joining surface 91.

In addition, as shown in FIG. 8D, the outer wall section 82 forms an atmosphere outlet section 85 by cutting a portion near a partition section 83. Furthermore, an outlet groove section 86*b*, which is connected to the atmosphere outlet section 85 and the groove section 86, is formed on the joining surface 91.

As shown in FIG. 8A, the partition section 83, which connects the inner wall section 89 and the outer wall section 82, is provided in the seal member 18, and the inlet groove section 86*a* and the outlet groove section 86*b* pinch the partition section 83 and are arranged opposite to each other.

As shown in FIG. 6, the seal member 18 having the configuration described above is pinched between the first flow path member 17 and the second flow path member 21. In other words, the joining section 17*a* of the first flow path member 17 is joined to the connection surface 91 of the seal member 18 and a seal receiving section 21*a* of the second flow path member 21 is joined to the joining surface 92.

The joining section 17*a* protrudes to the lower surface of the first flow path member 17 according to the shape of the seal member 18, and the width of which is formed narrower than the gap between the inner wall section 89 and the outer wall section 82 of the seal member 18. The joining section 17*a* is accommodated between the inner wall section 89 and the outer wall section 82 of the seal member 18, and abuts the entire the joining surface 91. At this time, the opening of the groove section 86 is sealed at the joining section 17*a* and thereby the atmosphere opening path 90 is formed.

The seal receiving section 21*a* is a region which is protruded at the surface where the third flow path member 19 of the second flow path member 21 is arranged according to the shape of the shell member 18. The seal receiving section 21*a* abuts the entire joining surface 92.

As described above, the seal member 18 is pinched by the first flow path member 17 and the second flow path member 21 and thereby the air chamber 100 is configured from the members.

The air chamber 100 communicates with the compliance space 56 of the head main body 14. Specifically, a second atmosphere communication hole 101 and a third atmosphere communication hole 103, which penetrate in the thickness direction, are provided in the second flow path member 21 and the third flow path member 19 respectively. The second atmosphere communication hole 101 communicates with the compliance space 56 of the head main body 14 and the third atmosphere communication hole 103 communicates with the second atmosphere communication hole 101 and the air chamber 100.

Furthermore, the air chamber 100 communicates with outside of the recording head 2 via the atmosphere opening path 90 provided in the seal member 18.

Specifically, as shown in FIGS. 8A and 8B, the inlet groove section 86*a*, which configures the atmosphere opening path 90, is connected to the atmosphere inlet section 84 and thereby the atmosphere opening path 90 communicates with the air chamber 100. Thus, gas in the air chamber 100 enters into the atmosphere opening path 90 via the inlet groove section 86*a* as shown in an arrow.

As shown in FIGS. 8A and 8C, the atmosphere opening path 90 is divided by the partition section 83 and thereby gas advances to the opposite side (in a clockwise direction in the view) the partition section 83.

As shown in FIGS. 8A and 8D, the outlet groove section 86*b*, which configures the atmosphere opening path 90, is connected to the atmosphere outlet section 85 and thereby the atmosphere opening path 90 communicates with the outside. Thus, as shown in an arrow, gas is discharged from the atmosphere opening path 90 to the outside.

As described above, the compliance space 56 communicates with the air chamber 100 via the first atmosphere communication hole 71, the second atmosphere communication hole 101 and the third atmosphere communication hole 103, and furthermore, communicates with the outside of the recording head 2 via the atmosphere opening path 90. In other words, the compliance space 56 is opened to the atmosphere. Accordingly, the compliance section 59 can be favorably deformed according to the pressure change of the manifold 52.

Here, as shown in FIG. 6, the third flow path member 19 is joined to the first flow path member 17 and the second flow path member 21 with the resin adhesive 102. A portion of the resin adhesive 102 exposes inside the ink reservoir 95 and other portions of the resin adhesive 102 exposes inside the air chamber 100. In other words, the ink reservoir 95 is divided with the air chamber 100 by the resin adhesive 102.

The resin adhesive 102 has nature that ink (liquid) is not penetrated, however, gas such as water vapor where moisture including ink evaporates and air bubbles included in ink is penetrated. Accordingly, ink is not leaked by penetrating the resin adhesive 102 in the air chamber 100 from the ink reservoir 95 and as shown in the arrow, water vapor from ink penetrates the resin adhesive 102 and thereby enters the air chamber 100. As the resin adhesive 102, for example, epoxy-based adhesive or the like may be used.

As described above, moisture can be prevented from excessively evaporating from ink inside the manifold 52 by configured the ink reservoir 95, the air chamber 100 and the resin adhesive 102. The configuration is described in detail using FIG. 9.

Figure 9:
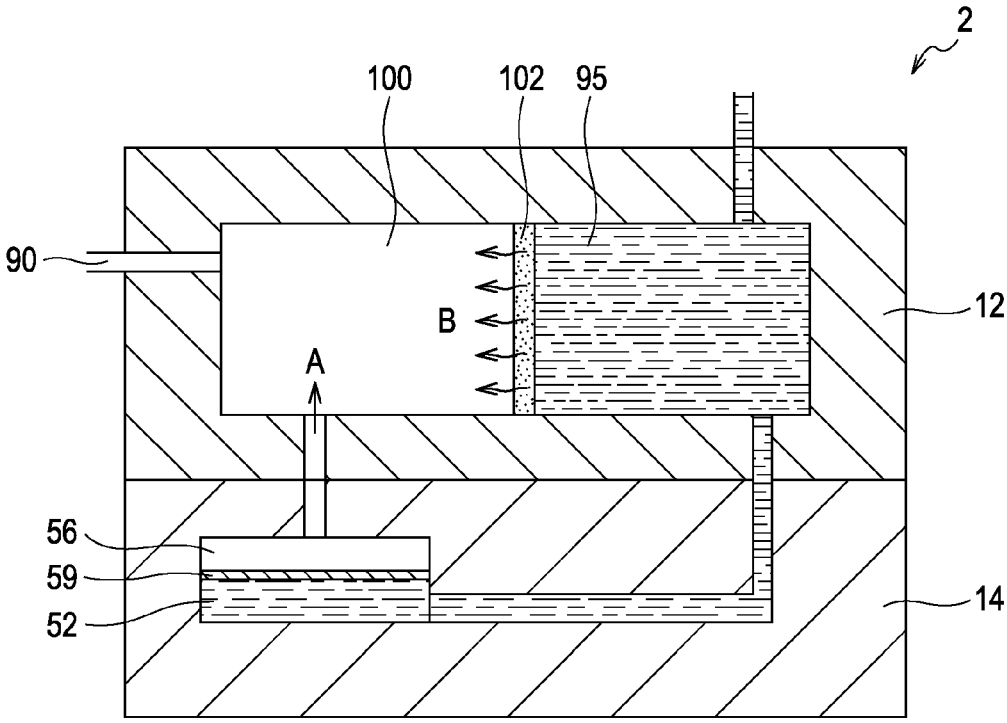

FIG. 9 is a schematic view illustrating relationship of the manifold 52, the compliance section 59, the compliance space 56, the ink reservoir 95 and the air chamber 100.

As shown in the same view, ink, which is supplied to the nozzles 36 (see, FIG. 7), is retained temporarily in the manifold 52. Moisture included in ink evaporates according to the environmental humidity and temperature on the recording head 2. Moisture included in ink evaporates a lot as the compliance space 56 dries. Thus, evaporated moisture penetrates the compliance section 59 and thereby enters the compliance space 56. After that, water vapor, which enters the air chamber 100 from the compliance space 56, is referred to as "water vapor A".

Meanwhile, the air chamber 100 and the ink reservoir 95 are divided by the resin adhesive 102. Ink as liquid also does not penetrate the resin adhesive 102 in the ink reservoir 95, however, water vapor, where moisture included in ink evaporates, penetrates the ink reservoir 95 and enters the air chamber 100. After that, water vapor, which enters the air chamber 100 from the ink reservoir 95, is referred to as "water vapor B".

Water vapor A is discharged to outside via the air chamber 100 and the atmosphere opening path 90. However, since water vapor B enters the air chamber 100 just before the atmosphere opening path 90, a diffusive resistance with respect to water vapor A, which is going to enter the air chamber 100, becomes large. Accordingly, water vapor A does not entire largely the air chamber 100 and quantity, which is remained inside the compliance space 56, becomes large.

As a result, the compliance space 56 is maintained in moister state with the water vapor A and thereby moisture from ink of the manifold 52 is suppressed from evaporating. Thus, the viscosity of ink also is suppressed by the evaporation of moisture.

In addition, since water vapor B enters the air chamber 100, it is considered that the viscosity of ink in the ink reservoir 95 increases. However, the volume of the ink reservoir 95 is greater than the volume of the manifold 52. In other words, ink quantity retained in the ink reservoir 95 is larger than the ink quantity retained in the manifold 52. Thus, the degree of the viscosity increase of ink due to the decrease of moisture in the ink reservoir 95 is smaller than the degree of the viscosity increase of ink in the manifold 52 and it may be almost ignored.

Here, since water vapor A is stayed in the compliance space 56 and the compliance space 56 is maintained in moister, a water vapor penetration rate of the resin adhesive 102 may be configured to be higher than that of the compliance section 59

(the elastic film 55). According to the configuration, water vapor B, which penetrates the air chamber 100 from the ink reservoir 95, may be larger than water vapor A which penetrates the compliance space 56 from the manifold 52. Accordingly, since water vapor B largely enters the air chamber 100, water vapor A stays in the compliance space 56 and the compliance space 56 can be maintained in moisture.

In addition, an area of a portion, where the resin adhesive 102 faces the air chamber 100, may be configured to be wider than that of a portion, where the compliance section 59 (the elastic film 55) faces the compliance space 56. According to the configuration, water vapor B, which penetrates the air chamber 100 from the ink reservoir 95, may be larger than water vapor A which penetrates the compliance space 56 from the manifold 52. Accordingly, since water vapor B largely enters the air chamber 100, water vapor A stays in the compliance space 56 and the compliance space 56 may be maintained in moisture.

Furthermore, the thickness from the ink reservoir 95 of the resin adhesive 102 to the air chamber 100 may be configured to be thinner than the thickness of the compliance section 59 (the elastic film 55). According to the configuration, water vapor B, which penetrates the air chamber 100 from the ink reservoir 95, may be larger than water vapor A which penetrates the compliance space 56 from the manifold 52. Accordingly, since water vapor B largely enters the air chamber 100, water vapor A stays in the compliance space 56 and the compliance space 56 is maintained in moisture.

As described above, the water vapor penetration rate, the area and the thickness of the resin adhesive 102 and the compliance section 59 are set as described above, and thereby the compliance space 56 is maintained in moisture and increase of the viscosity of ink inside the manifold 52 can be suppressed.

In addition, for example, the water vapor penetration rate of the resin adhesive 102 is lower than that of the compliance section 59. Meanwhile, the area of the portion of the resin adhesive 102, which faces the air chamber 100, is sufficiently larger than the area of the compliance section 59 which faces the compliance space 56, and thereby water vapor B, which enters the air chamber 100 may be larger than water vapor A. In other words, all of water vapor penetration rate, the area and the thickness of the resin adhesive 102 and the compliance section 59 are not required to be set as described above, and they are appropriately set and thereby water vapor B, which enters the air chamber 100 may be larger than the water vapor A.

As described above, the recording head 2 according to the invention is configured such that water vapor B generated from ink inside the ink reservoir 95 is entered into the air chamber 100 in the path from the compliance space 56 to the outside. According to the configuration, water vapor A generated from ink inside the manifold 52 stays in the compliance space 56 and the compliance space 56 is maintained in moisture. Since the compliance space 56 is in moisture, the evaporation of moisture included in ink inside the manifold 52 is suppressed and increase of the viscosity of ink inside the manifold 52 is suppressed. As a result, printing failure or the like according to increase of the viscosity of ink can be suppressed and the recording head 2, which performs high quality printing, can be supplied.

In addition, in the recording head 2 according to the member described above, the ink reservoir 95 and the air chamber 100 are formed in the flow path member 12, however, the members may be a certain members. For example, the ink reservoir 95 or the air chamber 100 may be provided in the head case 41 of the head main body 14.

In addition, the resin adhesive 102 is used as the resin member dividing the ink reservoir 95 and the air chamber 100, however, the invention is not limited to the embodiment. For example, the ink reservoir 95 and the air chamber 100 may be configured to be divided by the elastic film 55 such as PPS similar to the compliance section 59.

The atmosphere opening path 90 is provided in the seal member 18 as the configuration, which communicates the air chamber 100 to the outside, however, the invention is not limited to the embodiment. For example, the communicating hole, which communicates the air chamber 100 to the outside, may be provided in the first flow path member 17 or the second flow path member 21 defining the air chamber 100.

The piezoelectric element 43 of the vertical vibration type, where the piezoelectric material 61 and the electrode forming materials 62 and 63 are alternatively laminated, and extends and contracts axially, is exemplified as the pressure generating unit which generates the pressure change in the pressure generation chamber, however, the pressure generating unit is not specifically limited to the embodiment. For example, a piezoelectric element of a horizontal vibration type, where the piezoelectric material 61 and the electrode forming materials 62 and 63 are alternatively laminated, and one end thereof in the laminating direction is abutted to the vibration plate 51, may be used.

In addition, as the pressure generating unit, for example, a thin film type piezoelectric element, where a lower electrode, a piezoelectric body layer configured of the piezoelectric material and an upper electrode are formed by deposition and lithography method, may be used. In addition, a thick film type piezoelectric element, which is formed by a method of attaching a green sheet or the like, may be used. In addition, as the pressure generating unit, a configuration may be used, in which a heating element is disposed inside the pressure generation chamber and liquid droplets are discharged from the nozzle opening by bubbles generated by the heat of the heating element or static electricity is generated between the vibration plate and the electrode and thereby the vibration plate is deformed by the static electricity so that the liquid droplets are discharged from the nozzle opening.

In addition, as the ink jet type recording apparatus 1 described above, the apparatus, where the recording head 2 is equipped on the carriage 4 and moves in a main scanning direction, is exemplified, however, the invention is specifically not limited to the embodiment. For example, the invention may be applied to a so-called line type recording apparatus, where the recording head 2 is fixed and the recording sheet 6 such as the paper is moved in a sub-scanning direction and thereby performing the print.

In addition, in each of embodiments described above, the description of the ink jet type recording head as an example of the liquid ejecting head and the ink jet type recording apparatus as an example of the liquid ejecting apparatus is given, however, the invention is widely for overall the liquid ejecting head and the liquid ejecting apparatus and of course, the invention may be applied to a liquid ejecting head or a liquid ejecting apparatus which ejects liquid except ink. For example, various recording head using in an image recording apparatus such as a printer, a color material ejecting head using in producing of a color filter such as a liquid crystal display, an organic EL display, an electrode material ejecting head used in electrode formation such as a FED (a field emission display), a bio-organic body ejecting head used in producing a bio-chip or the like is exemplified as other liquid ejecting head, and the liquid ejecting apparatus including the liquid ejecting head may also be applied.

The entire disclosure of Japanese Patent Application No. 2011-171372, filed Aug. 4, 2011 is incorporated by reference herein.

What is claimed is:

1. A liquid ejecting head comprising:

a head main body having a manifold in which liquid is retained, a compliance section absorbing a pressure change inside the manifold and a compliance space provided opposite to the compliance section, and discharging liquid from nozzles communicating with the manifold;

an air chamber communicating with the compliance space and outside; and a liquid reservoir communicating with a liquid flow path supplying liquid to the manifold and volume of which is larger than the manifold, wherein the air chamber and the liquid reservoir are divided by a resin material where water vapor is capable of penetrating.

2. The liquid ejecting head according to claim 1, further comprising:

a first flow path member having a first flow path configuring a portion of the liquid flow path;

a second flow path member having a second flow path configuring a portion of the liquid flow path;

a third flow path member interposed between the first flow path member and the second flow path member; and a circular seal member interposed between the first flow path member and the second flow path member and arranged in circumference of the third flow path member, wherein the air chamber is configured by the first flow path member, the second flow path member and the seal member, the liquid reservoir is configured between the third flow path member, the first flow path member or the second flow path member, and communicates with the first flow path and the second flow path, and the air chamber and the liquid reservoir are configured by resin adhesive which is a resin member adhering the third flow path member, the first flow path member or the second flow path member to each other.

3. The liquid ejecting head according to claim 1, wherein water vapor penetration rate of the resin member is higher than water vapor penetration rate of the compliance section.

4. The liquid ejecting head according to claim 1, wherein an area where the resin member exposes to the air chamber is wider than an area where the compliance section faces the compliance space.

5. The liquid ejecting head according to claim 1, wherein a thickness of the resin member from the liquid reservoir to the air chamber is thinner than a thickness of the compliance section.

6. The liquid ejecting head according to claim 1, wherein the water vapor penetration rate, the surface area, and the thickness of the resin member or the compliance section are set so that quantity of water vapor penetrating the resin member from the liquid reservoir and entering the air chamber is larger than quantity of water vapor penetrating the compliance section from the manifold and entering the compliance space.

7. A liquid ejecting apparatus including the liquid ejecting head according to claim 1.

8. A liquid ejecting apparatus including the liquid ejecting head according to claim 2.

9. A liquid ejecting apparatus including the liquid ejecting head according to claim 3.

10. A liquid ejecting apparatus including the liquid ejecting head according to claim 4.

11. A liquid ejecting apparatus including the liquid ejecting head according to claim 5.

12. A liquid ejecting apparatus including the liquid ejecting head according to claim 6.

* * * * *